US005209468A

United States Patent [19]

Driscoll et al.

[11] Patent Number: 5,209,468

[45] Date of Patent: May 11, 1993

[54] ARTICULATED DOCUMENT FEEDER

[75] Inventors: James N. Driscoll, Perkasie; Michael R. Drago, Easton, both of Pa.

[73] Assignee: Bell & Howell Phillipsburg Company, Allentown, Pa.

[21] Appl. No.: 835,412

[22] Filed: Feb. 14, 1992

[51] Int. Cl.[5] ..... B65H 5/06

[52] U.S. Cl. ..... 271/274

[58] Field of Search ..... 271/272, 274; 226/21, 226/181, 186, 187, 179, 180, 185

[56] References Cited

U.S. PATENT DOCUMENTS

| | | | |
|---|---|---|---|
| 3,101,913 | 8/1963 | Davis | 226/187 X |
| 4,176,945 | 12/1979 | Holzhauser et al. | 355/23 |
| 4,297,045 | 10/1981 | Burton | 271/274 X |
| 4,346,883 | 8/1982 | Speraggi | 226/185 X |
| 4,431,303 | 2/1984 | Hoffman | 355/3 |
| 4,625,955 | 12/1986 | Snellman | 271/274 X |
| 4,836,525 | 6/1989 | Mizuno | 271/3 |
| 4,875,671 | 10/1989 | Sherburne | 271/302 |
| 5,031,893 | 7/1991 | Yoneda et al. | 271/65 |

OTHER PUBLICATIONS

Drawing No. 0022472 D-Admitted Prior Art.

*Primary Examiner*—Richard A. Schacher

*Attorney, Agent, or Firm*—Millen, White, Zelano & Branigan

[57] ABSTRACT

An articulated document feeder and diverter which allows pivoting and rotation about two mutually perpendicular axis of rotation to thereby allow idle rollers mounted on a pivotable carrier to maintain contact with drive rollers, whether a divert pivoting occurs or not. Compliance members, preferably resilient O-rings mounted on the periphery of the idle rollers, help to absorb unevenness in the contact face between an idle roller and a drive roller/s/.

9 Claims, 2 Drawing Sheets

ARTICULATED DOCUMENT FEEDER

FIELD OF THE INVENTION

This invention relates to document feeders; and, more particularly, the invention relates to a document feeder which has the capability of both adapting to non-uniformities of document feeder parts and of altering the flow path of a document propagated through a document handling apparatus.

BACKGROUND AND OBJECTS OF THE INVENTION

Document feeding mechanisms in document handling apparatus are generally characterized by at least one, preferably more, drive rollers which pinch a document between the drive roller(s) and so-called idle rollers. As the rollers rotate, a document pinched between them will be propagated. Preferably a plurality of idle rollers cooperating with at least one drive roller are disposed transversely to the direction of document propagation. Due to asymmetries between respectively cooperating drive and idle rollers, caused either initially by manufacturing tolerances, or subsequently by uneven wear, irregular, or asymmetric, feeding of the documents can result with consequent jams which lead to undesirable down-time of the document handling apparatus.

Accordingly, it is a primary object of this invention to minimize the consequences of asymmetries between cooperating idle, and drive, rollers.

The problems of asymmetry between cooperating idle, and drive, rollers become more acute when the document feeding apparatus is also asked to perform a second function, in addition to document feeding. When a document feeding mechanism is also used to alter, or divert, the flow path of a document to a different destination within the document handling apparatus, the repetitive motion required to repeatedly alter the direction of document motion will cause a build-up of wear likely to result in undesirable asymmetry.

Accordingly, it is another object of this invention to provide a document feeding and diverting device which adapts itself automatically to uneven wear between respective idle, and drive, roller assemblies.

A common form of diverting apparatus generally adds to a first set of idle rollers always in contact with drive roller(s) a second set of idle rollers spaced from the first set along the direction of document propagation. When a divert path for the document is desirable, the second set of idle rollers is also brought into temporary engagement with the periphery of the drive roller(s) by pivoting the second set about an axis that is the axis of rotation of the first set of idle rollers. Because such temporary engagements of the second set of idle rollers with the drive roller(s) occurs suddenly and with some rapidity, it is necessary to allow for some damping or compliance means between the second set of idle rollers and the drive roller(s) to lessen, or absorb, the shocks created by such rapid engagement.

Accordingly, it is another object of this invention to provide a document feeding and diverting device which provides for damping the sudden contact when a second set of idle rollers is rapidly brought into contact with a drive roller surface.

SUMMARY OF THE INVENTION

In a preferred embodiment of the invention, the document feeding and diverting assembly comprises a pair of two sets of idle rollers spaced transversely to the feeding direction of a document. A first set of two transversely spaced idle rollers of each of the pairs is always in contact with at least one drive roller, while a second set of two transversely spaced idle rollers is pivotable about a first axis into engagement with the drive roller when a document divert operation is desired. The first axis is the axis of rotation of the first set of two idle rollers. In addition to being pivotable about the first axis, each of the two sets of idle rollers is articulated to be also pivotable about a second axis, the second axis being perpendicular to the first axis.

As a result of the articulation, a set of idle rollers spaced transversely along the axis of rotation is thus able to "hug" the contours of the corresponding set of drive rollers, even if those contours should be asymmetric, i.e. differ along the periphery of the rollers.

To assure that the idle rollers remain in surface contact with the drive roller(s), regardless of surface discontinuities between their contact faces, compliance means are provided. These compliance means preferably comprise resilient O-rings mounted across the peripheral surface of the idle rollers. To account for the variable contact forces between, respectively, the first and second set of idle rollers and the drive roller(s), the first set of idle rollers has O-rings which have a higher hardness than the O-rings mounted on the periphery of the second set of idle rollers.

While the invention is illustrated in combination with a preferred embodiment in which the document feeding apparatus also functions as a document diverting apparatus, the invention is not so limited because the asymmetries to be described in greater detail will also arise in document feeding apparatus which has no diverting function.

The foregoing and other objects, features and advantages of the invention will be apparent from the following more particular description of several preferred embodiments of the invention, as illustrated in the accompanying drawings.

DETAILED DESCRIPTION OF THE INVENTION

Figure 1:
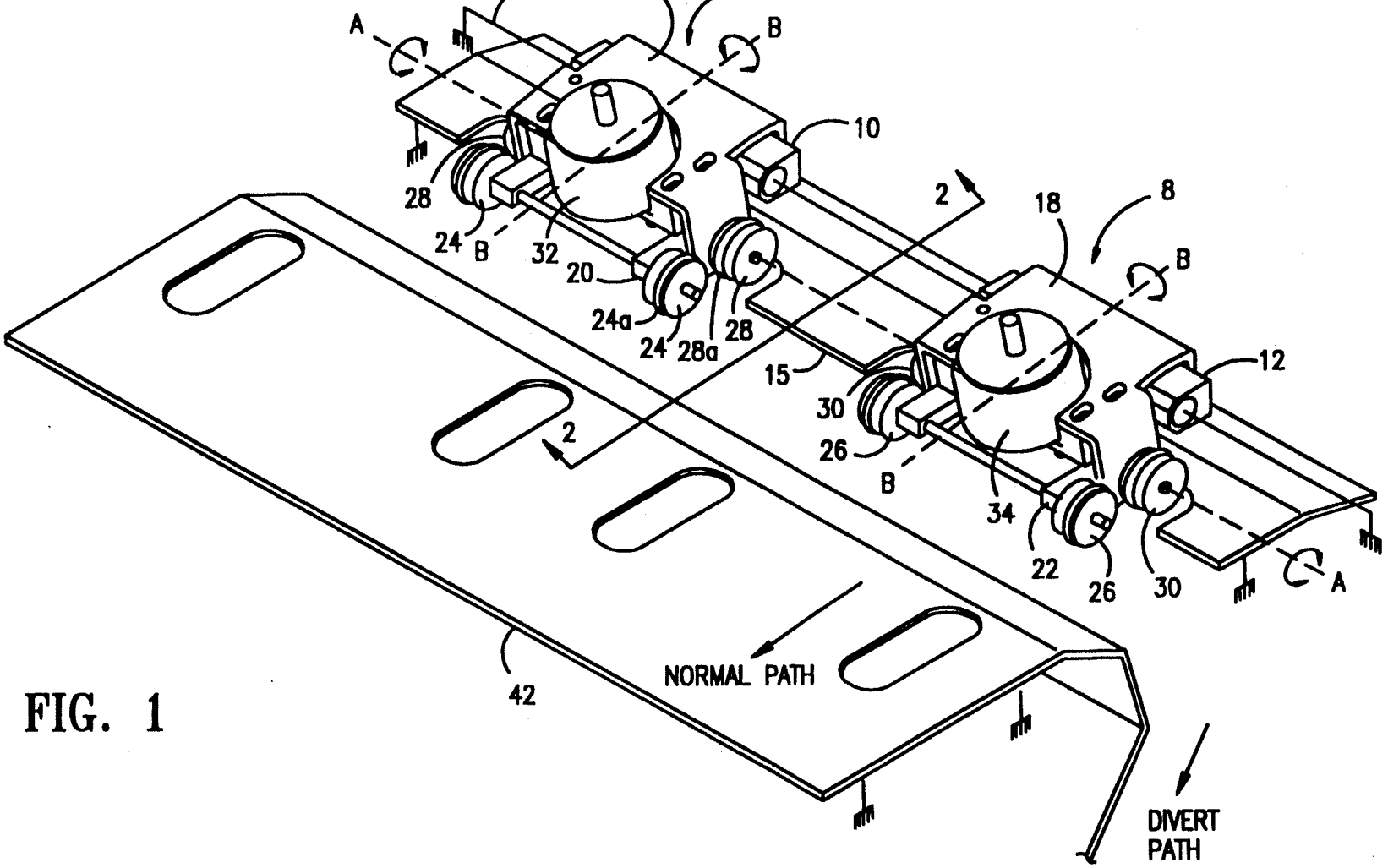
FIG. 1 is a partially isometric, partially schematic, view of two document feeding assemblies, with certain details omitted for purposes of clarity; and, FIG. 2 is a view of the apparatus shown in FIG. 1, along the line 2—2.

With reference to FIG. 1, two diverter assemblies 6, 8 are spaced transversely along an axis of rotation A—A. Hollow bearing sleeves 10, 12 are supported by a shaft 14, indicated schematically, which is firmly fixed to the document handling apparatus (not shown, for purposes of clarity). Each of the diverter assemblies 6, 8 is comprised of respective housings 16, 18 through which the bearing sleeve 10 projects, as at C (see FIG. 2) to thereby create a pivot bearing, so that the respective housings 16, 18 can pivot about the axes B—B.

Also mounted on the respective housings 16, 18 are respective idle roller carriages 20, 22 each of which, respectively, rotatably supports respective sets of idle rollers 24, 26. Each housing 16, 18 also supports respective sets of idle rollers 28, 30 (of which one is only partially shown because of the isometric view). However, it is to be understood, that each housing 16, 18 also has an idle roller spaced transversely from respective idle rollers 28, 30. Each of the sets of idle rollers 24, 26, 28 and 30 preferably has resilient O-rings, such as shown at 24a and 28a, surrounding their periphery. To account for the different loading of the respective sets of idle rollers O-ring(s) 24a are preferably made of a silicon, or fluorosilicon, compound having a rating of 50 Shore A Durometer, while O-ring(s) 28a are preferably made of a cast polyurethane compound having a rating of 70 Shore A Durometer. The O-rings constitute, and function as, compliance means between the contact face of idle and drive rollers and have a preferable thickness of about 3/32".

Figure 2:
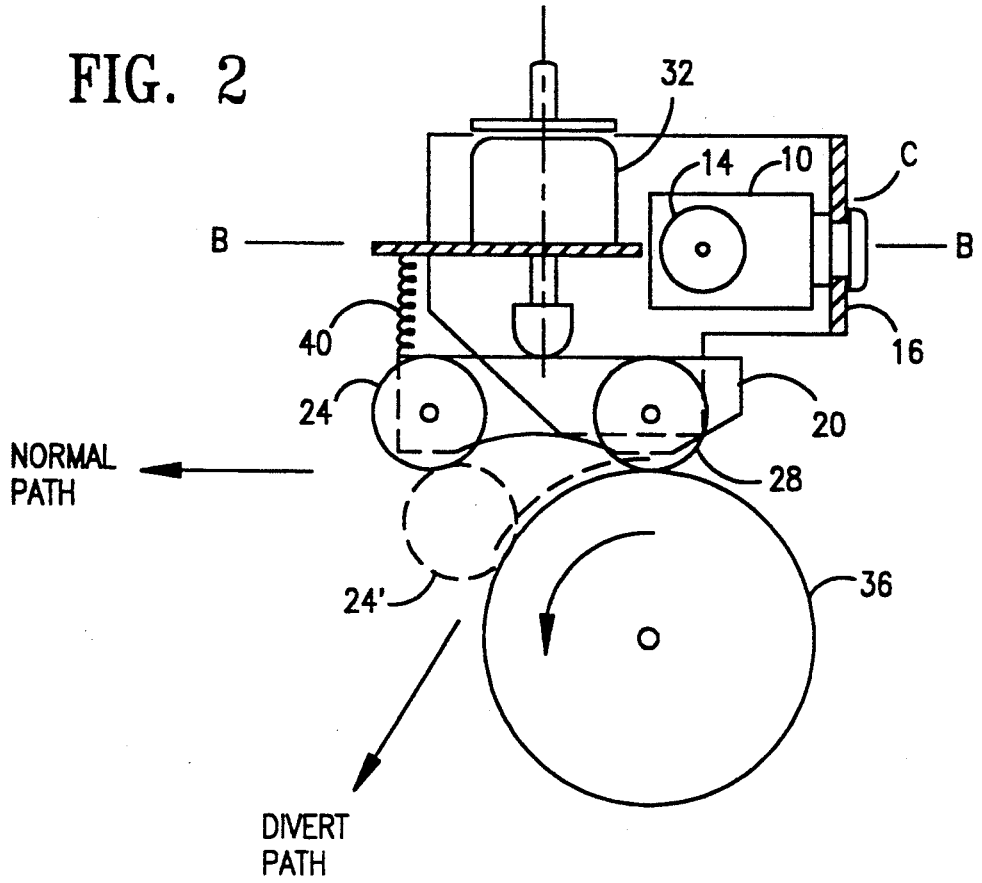

Respective solenoids 32, 34 are also supported by the respective housings 16 and 18 so that, upon actuation thereof, the respective pairs of idle rollers 24 and 26 are caused to pivot about axis A—A from a first position, as shown in FIG. 1, to a second position 24', as shown in FIG. 2, for the purposes to be hereinafter described.

Not shown in FIG. 1, but shown in FIG. 2, each of the respective sets rollers 28, 30 (and their partially shown transverse partners) have paired therewith a cooperating drive roller 36, as shown in FIG. 2.

With reference to FIG. 2, in which parts corresponding to FIG. 1 have the identical designation, each solenoid, such as 32, is comprised of a plunger 38 so that, when plunger 38 is actuated by solenoid 32, the idle roller carriage 20, pivotably supported in housing 16, is caused to pivot from the position shown in solid lines in FIG. 2 to the position indicated in dotted lines in FIG. 2, i.e. idle rollers 24 pivot about axis A—A to assume the position indicated at 24', to thus divert a document from support plate 14 from its normal path along the surface of support plate 42 to an alternate, divert path.

Upon deenergization of solenoid 32, a return spring 40 returns the idle roller carriage to the position shown in FIGS. 1 and 2 to cause document feeding along the normal path indicated.

Figure 3:
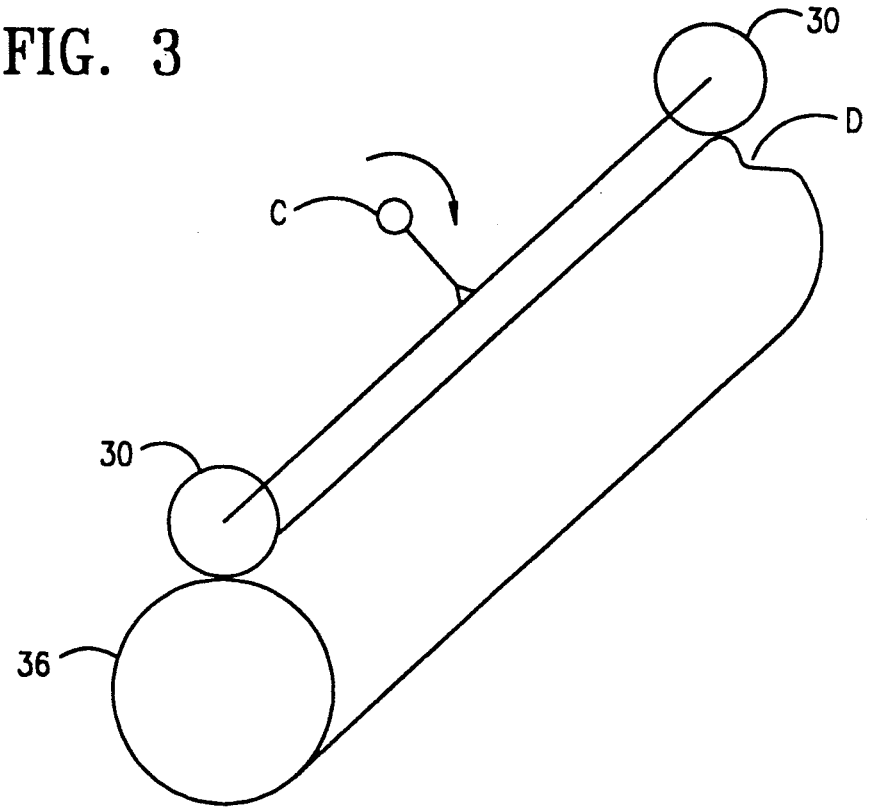
FIG. 3 is a simplified schematic view of the operation of the pivot mechanism with grossly exaggerated surface irregularities.

In operation, and as shown schematically in FIG. 3, each diverter assembly 6 and 8, having respective idle rollers 30, has cooperating therewith a drive roller 36. By virtue of the structure shown and described in FIGS. 1 and 2, any wear and tear causing asymmetrical contact faces between the respective idle rollers 30 and drive roller 36, is compensated for by allowing the idle rollers 30, to pivot about the pivot point C and axis B—B to thereby assure that contact is maintained between at least one pair of drive and idle rollers regardless of unevenness between their contact faces. Thus, if, for example, drive roller 36 has a depression (shown grossly exaggerated in at D FIG. 3) on its periphery, idle roller 30 will be able to track the depression by the pivotal movement about C of the housing containing idle rollers 30.

While the preferred embodiment of the invention has been illustrated as comprising two articulated document feeders, which preferably also function to divert documents, the invention is not so limited. Clearly, for appropriately dimensioned documents, only one assembly, i.g. 16, may be sufficient to adequately feed a document. Likewise, if no document diversion is desired, the feature allowing the pivotal motion of the respective sets of idle rollers 24 (or 26) may be dispensed with.

While the invention has been particularly shown and described with reference to a preferred embodiment thereof, it will be understood by those skilled in the art that the foregoing and other changes in form and details may be made therein without departing from the spirit and scope of the invention, as defined in the claims appended hereto.

What is claimed is:

1. In document feeding apparatus including idle rollers cooperating with drive roller means, said idle rollers spaced along the axis of rotation of the idle rollers and transversely to the document feed direction, the improvement comprising:

first housing means for supporting a first set of transversely spaced idle rollers, and first means, including a pivot bearing, allowing the first housing means and the first set of idle rollers supported thereby to pivot about an axis that is perpendicular to the axis of rotation of said first set of idle rollers, and drive roller means cooperating with said first set of idle rollers whereby each one of said first set of idle rollers retains a cooperative relationship with the drive roller means despite unevenness in a contact face between an idle roller and the drive roller means, and resilient compliance means disposed as to adapt to said unevenness in the contact face.

2. Apparatus according to claim 1, further including a second set of idle rollers supported by said first housing means and pivot means for allowing said second set of idle rollers to pivot between first and second positions around the axis of rotation of said first set of idle rollers.

3. Apparatus according to claim 2, further including:

second housing means for supporting a third set of transversely spaced idle rollers; and second means, including a pivot bearing, allowing the second housing means and the third set of idle rollers supported thereby to pivot about an axis that is perpendicular to the axis of rotation of said second set of the idle rollers, and drive roller means cooperating with said third set of idle rollers whereby each one of said third set of idle rollers retains a cooperative relationship with the drive roller means despite unevenness in the contact face.

4. Apparatus according to claim 2, wherein said pivot means further include solenoid means which, when actuated, causes said second set of idle rollers to pivot between first and second positions.

5. Apparatus according to claim 3 wherein said first and second housing means are spaced transversely along the axis of rotation of the idle rollers.

6. Apparatus according to claim 1 wherein said compliance means comprise resilient O-rings mounted on the periphery of said first set of transversely spaced idle rollers.

7. Apparatus according to claim 2 wherein said compliance means comprise resilient O-rings mounted on the periphery of said second set of transversely spaced idle rollers.

8. Apparatus according to claim 7 wherein the O-rings mounted on the periphery of said first set of transversely spaced idle rollers have a hardness differing from the hardness of the resilient O-rings mounted on the periphery of said second set of transversely spaced idle rollers.

9. Apparatus according to claim 8 wherein the hardness of the O-rings mounted on the periphery of said first set of transversely spaced idle rollers is greater than the hardness of the O-rings mounted on the periphery of said second set of transversely spaced idle rollers.

* * * * *